United States Patent [19]

Gatti et al.

[11] 4,177,859

[45] Dec. 11, 1979

[54] AIR CONDENSER

[75] Inventors: Maurizio Gatti, Sesto San Giovanni; Sergio Tavano; Basilio Checcacci, both of San Donato Milanese, all of Italy

[73] Assignee: Snamprogetti, S.p.A., Milan, Italy

[21] Appl. No.: 894,140

[22] Filed: Apr. 6, 1978

[30] Foreign Application Priority Data

Apr. 26, 1977 [IT] Italy ..... 22805 A/77

[51] Int. Cl.[2] ..... F28B 9/08

[52] U.S. Cl. ..... 165/11; 165/113; 165/114; 165/134 R; 165/174

[58] Field of Search ..... 165/110–113, 165/114, 11, 134, 174

[56] References Cited

U.S. PATENT DOCUMENTS

| | | | |
|---|---|---|---|
| 2,205,292 | 6/1940 | Howard | 165/114 |
| 2,217,410 | 10/1940 | Howard | 165/111 |
| 3,429,371 | 2/1969 | Palmer et al. | 165/112 |
| 3,598,179 | 8/1971 | Glauque | 165/113 |
| 3,612,172 | 10/1971 | Dohnt | 165/111 |
| 3,705,621 | 12/1972 | Schoonman | 165/112 |
| 3,814,177 | 6/1974 | Harris et al. | 165/110 |
| 3,825,062 | 7/1974 | Heller et al. | 165/111 |
| 3,968,836 | 7/1976 | Larinoff | 165/111 |

FOREIGN PATENT DOCUMENTS

| | | | |
|---|---|---|---|
| 900407 | 7/1962 | United Kingdom | 165/114 |
| 908429 | 10/1962 | United Kingdom | 165/111 |
| 1147148 | 4/1969 | United Kingdom | 165/111 |

*Primary Examiner*—Sheldon Jay Richter

*Attorney, Agent, or Firm*—Morgan, Finnegan, Pine, Foley & Lee

[57] ABSTRACT

An air condenser for condensing vapors where freezing or solidification of the condensate is likely to occur. Finned tube bundles are used, which are arranged so as to form a primary condensation zone and a secondary condensation zone. The tube bundles are placed at a slope and are struck by an air stream coming from below. The innermost tubes are directly struck by the cooling airstream and make up the first condensation zone. The outermost tubes receive air which has been preheated since it has flowed through the first condensation zone. These outermost tubes make up the second condensation zone. Thus vapors which are not condensed immediately are condensed in the second condensation zone. The apparatus is a compact, self-contained and efficient unit which is cheaper than the prior art devices both as to initial cost and upkeep cost.

5 Claims, 3 Drawing Figures

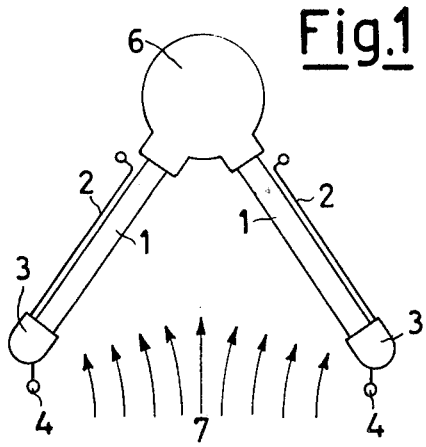
Fig.1
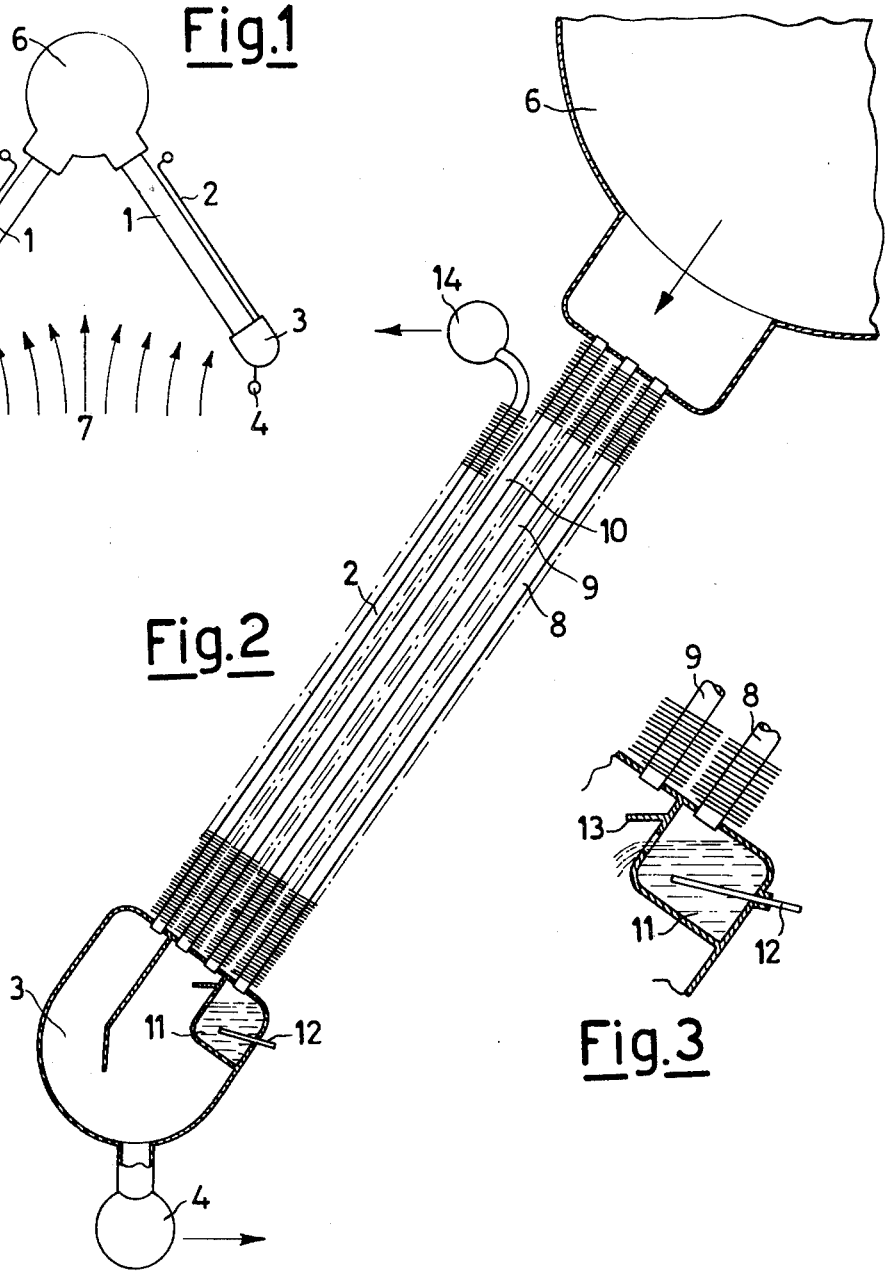
Fig.2
Fig.3

AIR CONDENSER

This invention relates to an air condenser. More particularly, the present invention relates to an air condenser which can preferably be used whenever, in connection with the environmental conditions and the characteristics of the fluid which is being processed, there is of freezing or solidifying.

Air condensers are known, such as that described in the U.S. Pat. No. 3,705,621 assigned to LUMMUS COMPANY. In condensers of this kind, condensation takes place in air-cooled tubes and, to prevent subcooling or freezing of the condensate from occurring in such tubes subject to the cooling action of air, the condensation of the vapors is only partial.

After having separated such condensates, the residual vapor fraction is generally caused to become condensed separately in a second section or portion of the apparatus known as a secondary condensation zone. It should be noted, at any rate, that the secondary condensation zone is struck at least partially, by air at the environmental conditions.

It has surprisingly been found that it is possible to offset the trouble of having to condense the vapors in two discrete and constructionally separated zones, by combining into a single condenser the two condensation zones, the primary and the secondary one. By so doing, a condensation system is provided which is more compact and requires reduced initial costs and upkeep costs over those of the known art. In addition, the more critical secondary condensation zone is completely struck by preheated air.

The object of the present invention is to provide an air condenser having finned tube bundles which are at a slope relative to the horizontal plane, wherein the bundles are composed of a number of tube rows, an inlet manifold for feeding the vapor to the tubes, collecting headers for the condensates with their attendant discharge and checking wells, a single collector for flushing all the condensate emerging from all the bundles aligned along a side of the apparatus and a single manifold for venting all the uncondensed fractions issuing from all the bundles aligned along one side of the same apparatus.

The tubes of each bundle are rigidly connected, at their bottom ends, to the collection headers for the condensate, while, at their top ends, the tube of the bundles, with the exclusion of the outermost rows which are struck last by already preheated air, are rigidly collected to the inlet manifold. By so doing, the tubes which are constrained at both their ends constitute the first condensation zone, whereas the remaining tubes, which are constrained only at their bottom ends constitute the second condensation zone.

BRIEF DESCRIPTION OF THE DRAWING

FIG. 1 illustrates the condenser of the present inventions.

FIG. 2 illustrates in greater detail the condensate collection header of the condenser of the present invention.

FIG. 3 illustrates in greater detail the inspection well of the condensate collection header of the present invention.

In FIGS. 1, 2 and 3 of the accompanying drawing, there is a complete showing of the condenser with its primary condensation zone, 1 and the secondary condensation zone, 2. In the drawing the second condensation zone is formed, for the sake of simplification, by a single tube row, but the possibility is not excluded of using a number or rows. Also shown are the condensate collection headers 3, the condensate discharge manifolds 4 and the manifold 6 for feeding vapors to be condensed to the tubes. Cooling air 7, is blown from below by a blower which is not shown.

With the arrangement of FIG. 2 it is now possible to describe in more detail the method by which the condenser is operated. The vapor coming from the manifold 6 enters the tubes 8, 9 and 10 of the primary condensation zone, which are swept by the cooling air and is condensed almost completely in the first tube row 8, and partially in the remaining tubes: only three tube rows have been shown in the drawing for simplify the showing.

The mixture of vapor and liquid exiting the tube rows 9 and 10 is collected in the condensate collection header 3, whereas the liquid exiting the row 8 is passed, prior to entering the manifold 3, through an inspection well 11, so as to check the temperature of the mixture by means of specially provided sensor, 12.

This check is made to prevent the condensate from reaching temperature values which are too low, to thereby prevent the condensate from freezing or solidifying.

FIG. 3 shows a detailed example of an inspection well for condensate checking. The reference numerals are the same as in FIG. 2, with the exception of numeral 13 which indicates the shield plate for the outlet port for the condensate from the inspection well.

In the condensate collection headers 3 the liquid and the vapor phases are separated from one another, the liquid phase being discharged through the manifolds 4 whereas the vapor phase, a residue from the first zone, rises along the tubes of the secondary condensation zone 2, which is the most exposed to the freezing and solidification hazards.

In the present invention the tubes of the secondary condensation zone are, totally struck by the air coming from the first zone of condensation: the air is preheated but is capable, at any rate, of completely condensing the remaining portion of vapors. Also differential sizing of the heat-exchanging surfaces of the several tube rows facilities complete condensation.

The condensate which is gradually being produced reflows in counterflow relationship relative to the rising vapor, thus further encouraging both the condensation of the vapor and achieving an equilibrium between the liquids and the vapors. Thus, at the outlet end 14 of the tubes of the second condensation zone there are only uncondensable gases.

It is apparent that the present invention can be used with vertical tubes provided that the tubes are constrained at their top and bottom ends in the manner described herein.

We claim:

1. An air condenser comprising:

finned tube bundles positioned at a slope relative to the horizontal plane, wherein the tubes are arranged in rows and are divided into two zones, an inlet manifold connected to one end of the tubes in said first zone for feeding vapor thereinto, a collection header connected to the tubes of both zones at the other ends thereof for collecting condensate from said tubes and for feeding residual vapors from said tubes of said first zone into each of the tubes of said second zone, collection means connected to the one end of each tube of said second zone for collecting residual vapors from each of said tubes in said second zone, said tubes of each of said zones being adapted to be swept by cooling air such that the air first strikes the tubes of said first zone and then each of said tubes of said second zone, and wherein the outermost tube of said first zone is adapted to be initially struck by said cooling air so that vapor in said first tube of said first zone is almost completely condensed, an inspection well within said collection header open to said header and said first tube of said first zone for receiving condensate therefrom prior to such condensate entering said collection header, and a sensor extending into said inspection well for checking the temperature of the condensate therein to prevent the condensate from reaching freezing or solidifying temperatures.

2. The air condenser of claim 1, wherein said liquid and vapor phases are divided within said collection header so that the residual vapor phase rises from said header into each of said tubes of said second zone, and the liquid phase is discharged from said header into manifold connected thereto.

3. The air condenser of claim 1, wherein said tubes of said first zone heats the air striking said tubes so that such air is pre-heated prior to striking each of said tubes of said second zone.

4. The air condenser of claim 1, wherein condensate is gradually produced in each of said tubes of said second zone and flows in a counterflow direction to the rising vapors therewithin to maximize condensation of vapors so that at the outlet ends of each of said tubes of said second zone there remain only uncondensable gases.

5. The air condenser of claim 1, wherein said inspection well includes a plate which forms said well, and wherein said plate has a port therein open to said collection header through which the condensate flows after it has entered said well.

* * * * *

UNITED STATES PATENT AND TRADEMARK OFFICE

CERTIFICATE OF CORRECTION

PATENT NO. : 4,177,859
DATED : December 11, 1979
INVENTOR(S) : MAURIZIO GATTI, ET AL.

It is certified that error appears in the above-identified patent and that said Letters Patent are hereby corrected as shown below:

First page, In the Abstract, line 12, correct "are" to read --were--.

Col. 1, line 9, after "there is" insert --a risk--.

line 22, after "struck" insert a comma --,--.

Col. 2, line 42, after "are" delete the comma ",".

Signed and Sealed this

*Eighth* Day of *April 1980*

[SEAL]

*Attest:*

SIDNEY A. DIAMOND

*Attesting Officer*

*Commissioner of Patents and Trademarks*